US005192097A

United States Patent [19]

Su

[11] Patent Number: 5,192,097

[45] Date of Patent: Mar. 9, 1993

[54] PLASTIC DOOR LOCK

[75] Inventor: Jyh-Yeong Su, Kaohsiung, Taiwan

[73] Assignee: Jyi Shen Industrial Co., Ltd., Taipei, Taiwan

[21] Appl. No.: 855,865

[22] Filed: Mar. 23, 1992

[51] Int. Cl.[5] ..... E05C 1/14

[52] U.S. Cl. ..... 292/166; 292/336.3; 292/DIG. 26; 292/153; 292/357; 292/DIG. 31; 411/41; 411/508

[58] Field of Search ..... 292/166, 153, 174, 357, 292/DIG. 26, DIG. 31, DIG. 38, 336.3; 411/41, 60, 508

[56] References Cited

U.S. PATENT DOCUMENTS

| | | | |
|---|---|---|---|
| 2,547,546 | 4/1951 | Stulpin et al. | 292/166 |
| 2,929,649 | 3/1960 | Coe | 292/357 X |
| 2,941,439 | 6/1960 | Rapata | 411/41 |
| 3,909,051 | 9/1975 | Nokai | 292/166 |
| 4,116,027 | 9/1978 | Tannery | 292/DIG. 31 X |
| 5,031,268 | 7/1991 | McCabe | 411/41 X |

*Primary Examiner*—Richard E. Moore
*Attorney, Agent, or Firm*—Bacon & Thomas

[57] ABSTRACT

A plastic door lock comprises opposed flat inner and outer cover plates (1,1') each recessed to house slidable drag units (3,3'), and a core unit (2) located between the cover plates (1,1') housing a latch unit (4) which, on sliding movement of the drag units (3,3'), can be moved between a closed position and an open position. A limit switch (25) housed in the inner cover plate (1') can be pivoted between an unlocked position permitting movement of both the inner and outer drag units (3,3') to actuate the latch unit (4), and a locked position preventing movement of the outer drag unit (3) but being such that, on movement of the inner drag unit (3'), the limit switch (25) is returned to its unlocked position to enable actuation of the latch unit (4) from inside the door. The components of the lock are moulded from a plastics material.

10 Claims, 5 Drawing Sheets

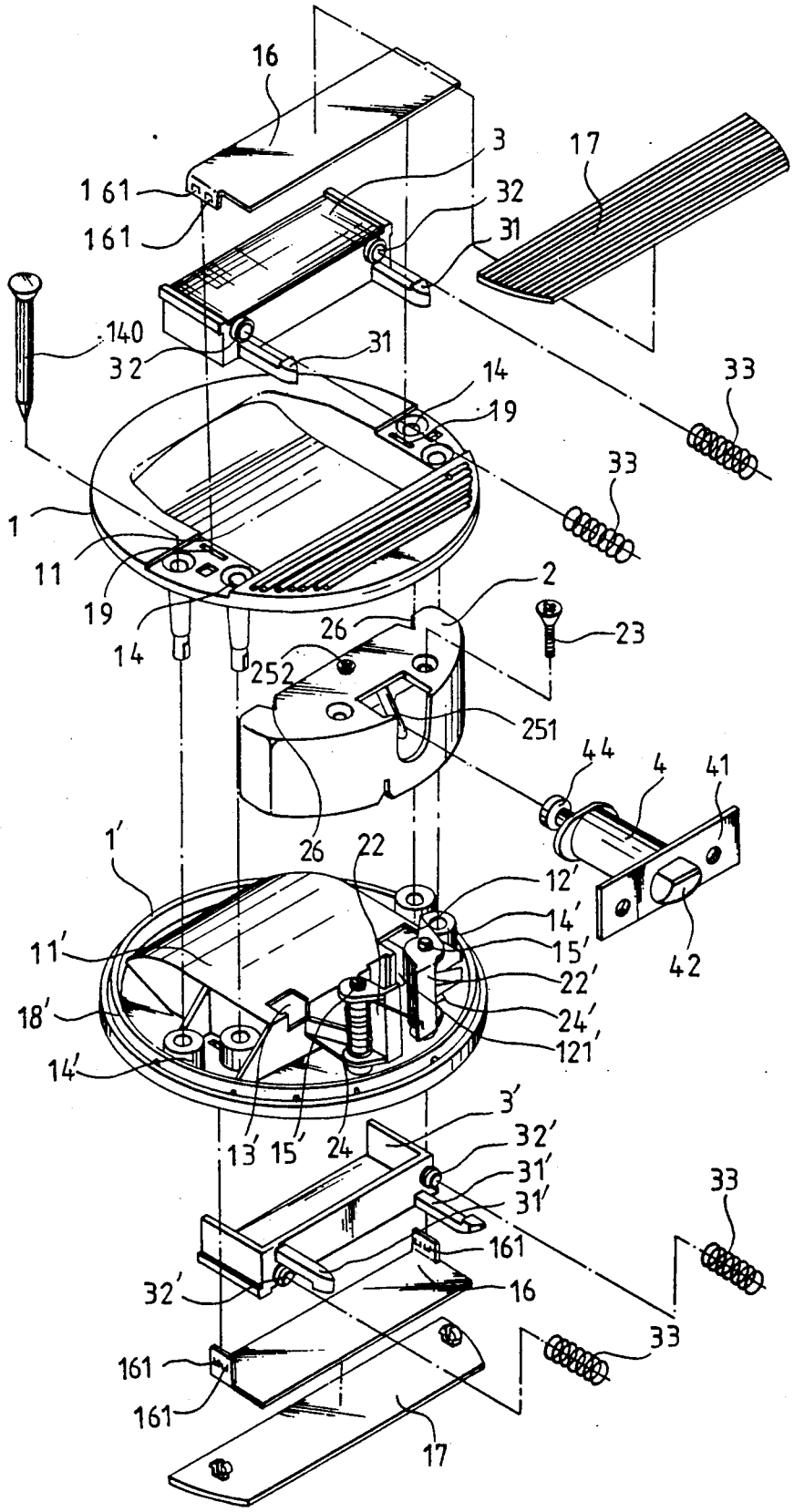
FIG,1

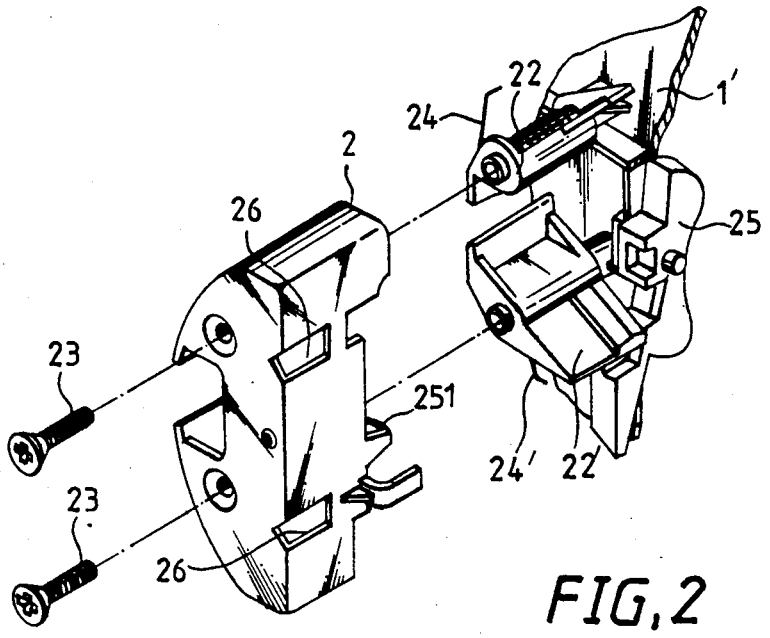
FIG, 2
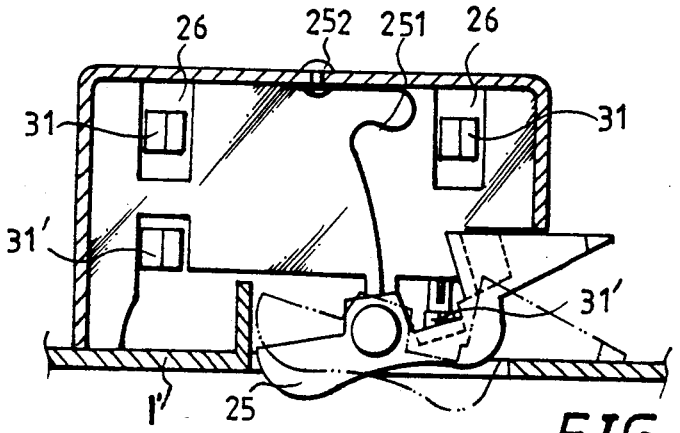
FIG, 3
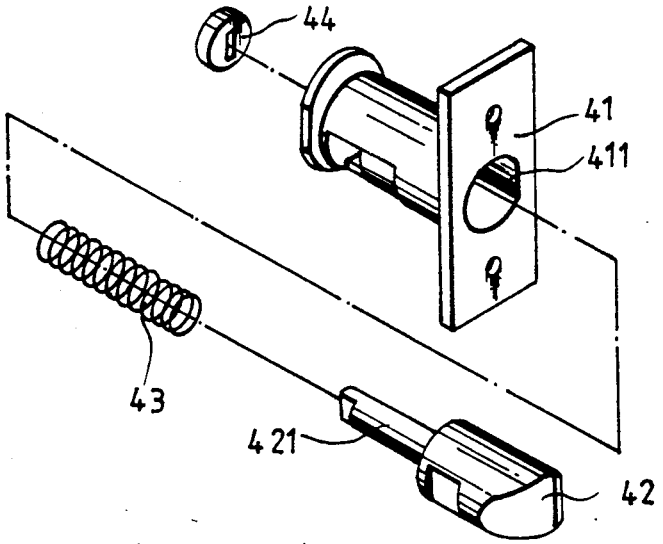
FIG, 4

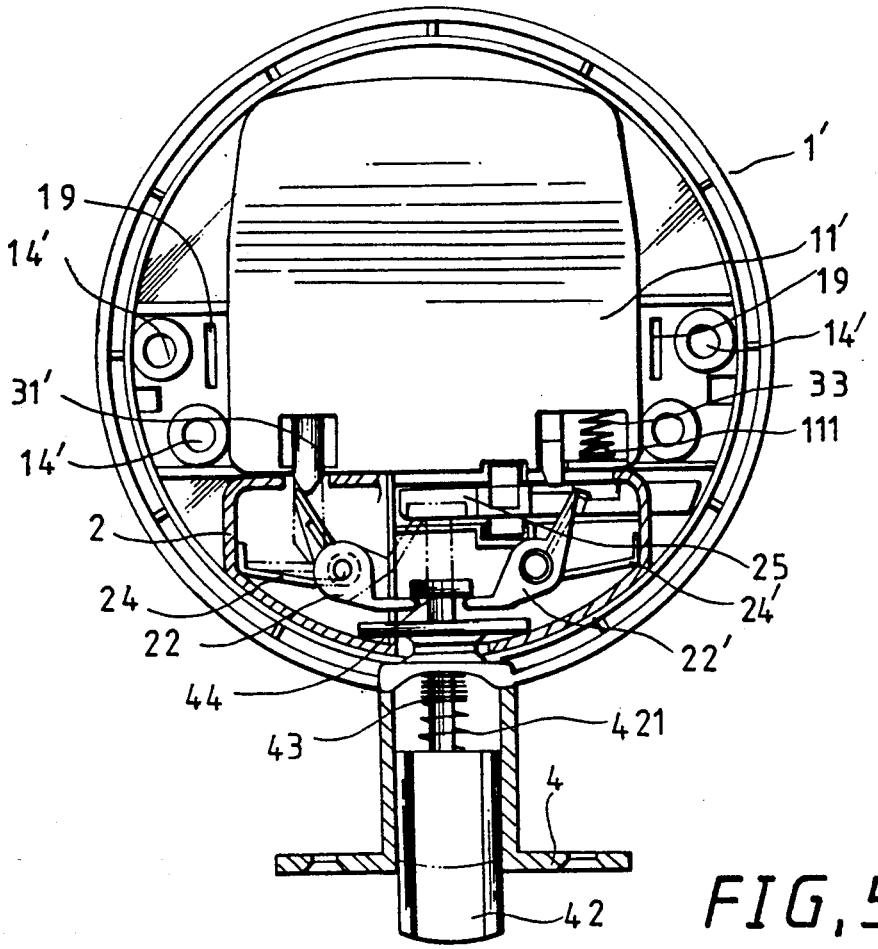
FIG, 5
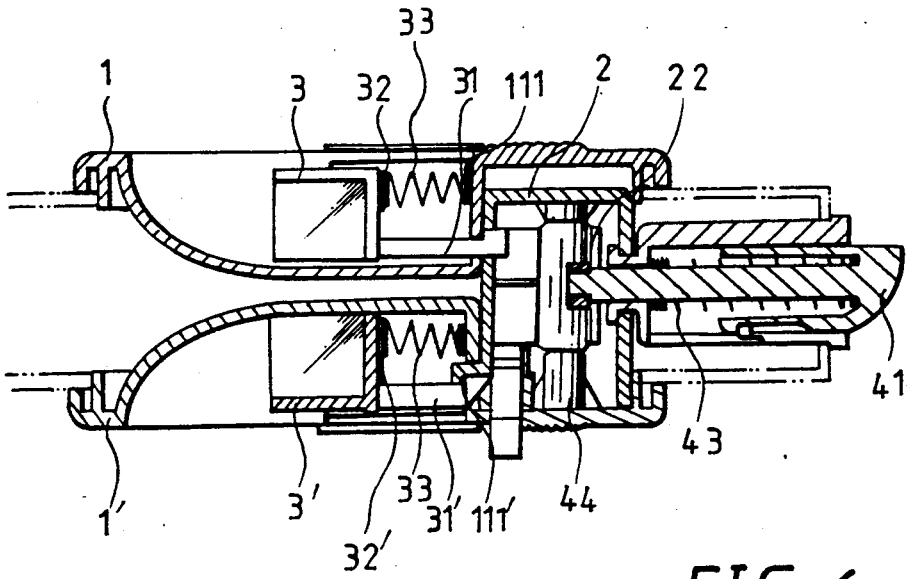
FIG, 6

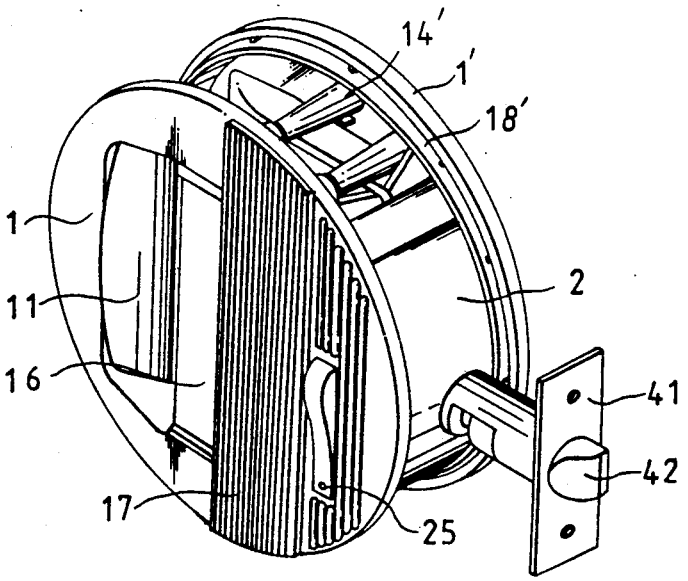
FIG, 7
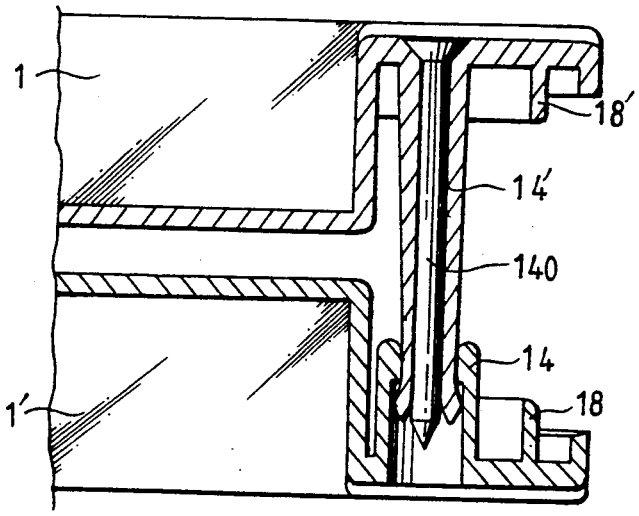
FIG, 8
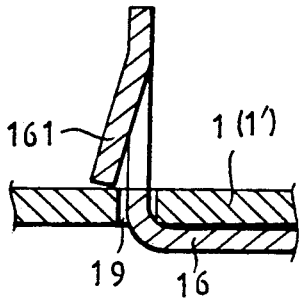
FIG, 9

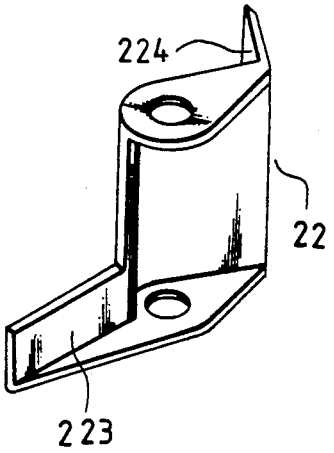
FIG,10
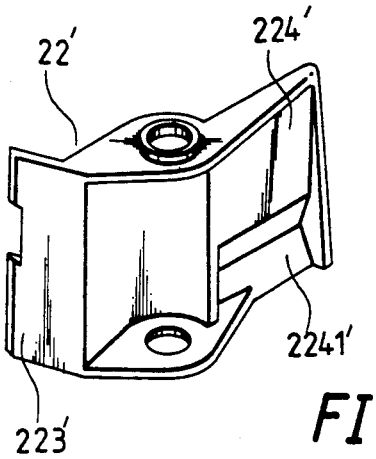
FIG,11
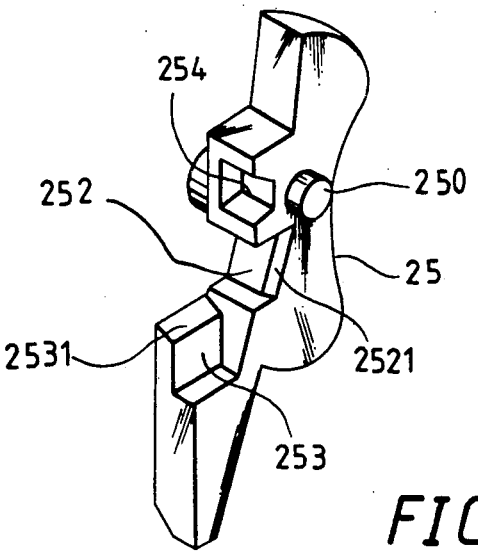
FIG,12

PLASTIC DOOR LOCK

BACKGROUND OF THE INVENTION (a) Field of the Invention

The present invention relates to a plastic door lock, and more particularly to such a lock of simple construction that can be locked and unlocked easily without use of any key.

(b) Description of the Prior Art

Normally, on kitchen, toilet and bathroom doors, cylindrical locks are used which can be opened without the used of a key. However, such locks are commonly made of metal, a lot of parts are involved, and assembly and installation of the lock are difficult. Moreover, the projecting cylindrical portion to be gripped to open the lock can cause injury due to accidental collision, particularly by childern, and its size is substantial. Therefore, there are defects to be overcome.

SUMMARY OF THE INVENTION

It would be desirable to be able to provide a light and compact plastic door lock of simple constructions and assembly which eliminated the outwardly projecting handles associated with conventional locks.

According to the present invention there is provided a door lock comprising opposed, substantially flat inner and outer cover plates each of which is recessed to receive therein an associated drag unit slidable relative to the cover plate between a rest position and a displaced position, a core unit located between the cover plates and including a pair of dragging elements each pivotal about an associated axis extending substantially perpendicular to the plane of the sliding movement of the dragging elements between a rest position and a displaced position, the dragging elements co-operates with a latch unit whereby, on movement of the dragging elements from their rest positions to their displaced positions, the latch unit is moved from a normally closed position to an open position, and a limit switch mounted in the inner cover plate to be pivotal between a locked position and an unlocked position. The arrangment being such that, with the limit switch in the unlocked position, both of the drag units can be moved relative to the associated cover plate from their rest positions to their displaced positions to engage associated dragging elements to pivot the dragging elements and to actuate the latch unit, and, with the limit switch in its locked position, movement of the outer drag unit is prevented but, on initial movement of the inner drag unit from its rest position towards its displaced position, the limit switch is pivoted by the inner drag unit from its locked position to its unlocked position, the inner drag unit further engaging a dragging element to pivot the element towards its displaced position to actuate the latch unit.

Conveniently each drag unit is urged towards its rest position by associated resilient means, while it is preferred that each drag unit includes an abutment projecting therefrom and adapted to engage with, to pivot, associated dragging elements on sliding movement thereof.

Conveniently each dragging element is urged towards it rest position by associated resilient means, while it is preferred that each dragging element comprises a pair of wing portions one to each side of a substantially central pivot region, one wing portion of each dragging element being located to co-operate with the latch unit to effect movement thereof from its closed position to its open position, and the other wing portion of each dragging element being located for abutment by an associated drag unit.

The limit switch may be pivotal about an axis extending parallel with the direction of sliding movement of the drag units into a closed position engaging with the other wing portion of one of the dragging elements to prevent pivoting movement of that one dragging element on abutment by the outer drag unit, the configuration of the inner drag unit and the limit switch being such that, with the switch in its closed position and on sliding movement of the inner drag unit towards its displaced position, the limit switch is pivoted from its closed position to its open position to disengage the switch from the one dragging element, continued sliding movement of the inner drag unit pivoting the other dragging element to actuate the latch unit.

In a preferred embodiment, each cover plate includes a corresponding plurality of hollow posts projecting inwardly therefrom, the posts of one plate co-operating with the posts of the other plate to effect initial interconnection of the plates. Fasteners are then inserted within the hollow posts effecting permanent interconnection of the plates.

Preferably the cover plates, the drag units, the core unit and the dragging elements are all moulded from a plastics material.

BRIEF DESCRIPTION OF THE DRAWINGS

FIG. 1 is a perspective fragmented view of a plastic door lock according to the present invention.

FIG. 2 is a perspective fragmented view of a core unit and part of a cover plate of a door lock according to the invention.

FIG. 3 is a sectional view of the core unit shown in FIG. 2.

FIG. 4 is a perspective fragmented view of a latch unit of a door lock according to the invention.

FIG. 5 is a sectional view of a plastic door lock according to the invention.

FIG. 6 is a longitudinal sectional view of a plastic door lock according to the invention.

FIG. 7 is a perspective view of a plastic door lock according to the invention.

FIG. 8 illustrates the engagement between two hollow posts of the two cover plates of a door lock according to the invention.

FIG. 9 illustrates a positioning plate on the cover plate of a door lock according to the invention.

FIGS. 10 and 11 show the two dragging elements of a lock according to the invention in more detail, and FIG. 12 shows the limit switch of a lock according to the invention in more detail.

DETAILED DESCRIPTION OF THE PREFERRED EMBODIMENT

As shown in FIG. 1, the door lock of the present invention comprises mainly two thin, flat cover plates 1, 1', a core unit 2, two drag units 3 and a latch unit 4, all made of plastic material by an injection molding process.

The cover places 1, 1' are two symmetric flat structures, provided with recesses 11,11' in each of which are formed a notch 12' at one corner and another notch 13' at another corner. A narrow passage 121' extends vertically downwards from the notch 12' in the cover plate 1'. The cover plate 1' is provided with hollow posts 14', while the other cover plate 1 is provided with corresponding hollow posts 14 for mutual engagement with the posts 14' and retention together by means of nails 140 as seen in FIG. 8.

The core unit 2 comprises a hollow housing of an appropriate size having a latch hole 21 in the middle. AS shown in FIG. 2, there are two opposed, wing-like dragging elements 22,22' in the core unit 2. Each of the dragging elements 22,22' is mounted on a hollow post 15' and is surrounded by a torsional spring 24,24' for rotation. A limit switch 25 is pivoted to the bottom of the core unit 2, and the limit switch 25 is subject to a pressure exerted by a spring plate 251 which is fixed to the inner wall of the core unit 2 by a rivet 252 so that the limit switch is retained and is pivotal about a shaft 250. The core unit is normally closed with the switch 25 as shown in full lines in FIG. 3.

More particularly, and referring to FIGS. 10 and 11, the two dragging elements 22,22' are slightly different from one another. Element 22 includes a full length wing 224 at one side and a shorter wing 223 at the other side, while the element 22' has opposed full length side wings 223' and 224' thereon, the back of the wing 224' being recessed at 2241'.

As mentioned above and referring in particular to FIG. 12, the limit switch 25 is pivotal about a shaft 250, the end of the spring plate 251 abutting a slot 254 in the switch 25. The switch 25 has a notch 252 formed therein to one side of the shaft 250, the rear side of the notch 252 being tapered at 2521. The rear of the switch 25, adjacent the notch 252, is stepped at 253, the edge of this step being tapered at 2531.

The rear face of the core unit 2 is provided with two holes 26 for reasons which will become apparent.

Each of the drag units 3,3' is in the form of a symmetrical rectangular structure of a size for close sliding movement within the associated recess 11,11' of the cover plate 1,1' Two hooks 31,31' are formed on one end of each drag unit 3,3' one extending from each side of each end. The two hooks 31' extending from the end of the drag unit 3' are on different levels from each other. Each of the hooks 31,31' has associated therewith a spring retainer 32,32' above or below it for retaining one end of an associated spring 33, while the other end of each spring 33 is retained by another spring retainer 111,111' on the inner surface of the recess 11,11' of the cover plate 1,1', as shown in FIGS. 5 and 6, so that the two drag units 3,3' can be extended and retracted within the recesses 11,11' relative to the plates 1,1'. The ends of the hooks 31 on the drag unit 3 are aligned with the holes 26 in the core unit 2 for passage therethrough on said sliding movement.

As shown in FIG. 4, the latch unit 4 is composed of a latch body 41 and a latch element 42. The latch element 42 is located in a hole 411 of the latch body 41. The latch element 42 has an extension 421 which is surrounded by a spring 43, the spring 43 being housed within the latch body 41 to react between the body 41 and the latch element 42, the free end of the extension 42 projecting from the latch body 41 to be retained relative thereto by an annular retainer 44 and whereby the latch element 42 can move against the bias of the spring 43 relative to the latch body 41.

The core unit 2 is fixed to the cover plate 1' by means of two fixing screws 23 screwed into the hollow posts 15'. Each of the drag units 3,3' is fixed in the recess 11,11' of the cover plate 1,1', the cover plates 1,1' are fixed together, and a positioning plate 16 and a decorative element 17 are then adhered to the external surfaces of the cover plates 1,1' respectively to complete the assembly of a plastic door lock according to the present invention, as shown in FIG. 7. Then, by means of the latch unit 4, the lock can be opened or closed.

The plastic door lock according to the present invention is used mainly on doors for kitchens, toilets or bathrooms. The cover plate 1' with the limit switch 25 is positioned at the inner side of a door to enable opening of the door lock from the outside to be prevented.

The described lock operates as follows. With the limit switch 25 in the unlocked position as shown in dotted lines in FIG. 3, the lock can be operated from the inside or from the outside. On sliding movement of the outside drag unit 3, a hook 31 abuts the wing 224' of the dragging element 22' to pivot dragging element 22' against the action of the torsional spring 24' whereby the latch element 42 is withdrawn against the bias of spring 43 by engagement of the wing 223 of the element 22' with the annular retainer 44 of the latch unit 4.

On sliding movement of the inside drag unit 3', the associated hook 31' similarly abuts the shorter wing 223 of the dragging element 22 to pivot the element 22 against the bias of the spring 24 to operate the latch unit 4. On sliding movement of the unit 3', the other hook 31' thereon passes through the notch 252 in the limit switch 25 without engaging said switch and passes below the element 22'.

The locked position of the limit switch 25 is shown in full lines in FIG. 3 in which position the wing 224' of the dragging element 22' engages the step 253 of the switch 25 to prevent rotation of the element 22'.

Thus, on attempted sliding movement of the outside drag unit 3, the element 22' cannot rotate on abutment by the associated hook 31, and the lock cannot be operated from the outside.

On sliding movement of the inner drag unit 3', the hook 31', adjacent the dragging element 22, slides over the tapered surface 2521 of the notch 252 to pivot the switch 25 about the shaft 250 from its locked position to its unlocked position whereby, on continued sliding movement of the unit 3', the other hook 31' abuts the dragging element 22 to rotate element 22 and actuate the lock.

A recessed stepped ring 18,18' is provided on the circumference of each cover plate 1,1' to facilitate installation of the plastic door lock in a lock hole on a door (not shown). The hollow post 14' on the cover plate 1' is formed with a gradually decreasing diameter for inserting into the correspondingly-positioned hollow post 14 on the other cover plate 1 for initial positioning purposes. Then, on insertion of the nail 140, the hollow post 14' is expanded for permanent positioning as shown in FIG. 8.

The positioning plate 16 outside the cover plate 1,1' is provided with bent end portions each formed with a pair of tongues 161 such that, on insertion of the end portions into associate 19 in the cover plate 1,1', the plate 16 is retained on the cover plate 1,1' as shown in FIG. 9. Therefore, installation of the positioning plates 16 is very easy.

Thus there is provided a light, compact door lock of simple construction the components of which are all made of plastic material by injection moulding techniques whereby the lock is easy to produce and assemble and whereby the projecting handles of conventional cylindrical locks are eliminated to prevent injury due to collision.

I claim:

1. A door lock comprising opposed, substantially flat inner and outer cover plates each of which is recessed to receive therein an associated drag unit slidable relative to the cover plate between a rest position and a displaced position, a core unit located between said cover plates including a pair of dragging elements each being pivotal, about an associated axis extending substantially perpendicular to the plane of the sliding movement of the drag units, between a rest position and a displaced position, said dragging elements co-operating with a latch unit whereby, on movement of the dragging elements from their rest positions to their displaced positions, the latch unit is moved from a normally closed position to an open position, and a limit switch pivotally mounted on the inner cover plate between a locked position and an unlocked position, said limit switch being formed with a notch having an associated surface position, the arrangement being such that, with the limit switch in the unlocked position, both of the drag units can be moved relative to the associated cover plate from their rest positions to their displaced positions to engage associated dragging elements to pivot said dragging elements and to actuate the latch unit with at least a portion of the inner drag unit being permitted to freely extend through the notch formed in said limit switch and, with the limit switch in its locked position, movement of the outer drag unit is prevented but, on initial movement of the inner drag unit from its rest position towards its displaced position, the inner drag unit engages the surface portion associated with said notch to cause the limit switch to be pivoted by said inner drag unit from its locked position to its unlocked position, said inner drag unit further engaging a dragging element to pivot said element towards its displaced positions to actuate the latch unit.

2. A door lock as claimed in claim 1 in which each drag unit is urged towards its rest position by associated resilient means.

3. A door lock as claimed in claim 1 in which each drag unit includes abutment means projecting therefrom and adapted to engage with, to pivot, associated dragging elements on sliding movement thereof.

4. A door lock as claimed in claim 1 in which each dragging element is urged towards its rest position by associated resilient means.

5. A door lock as claimed in claim 4 in which each dragging element comprises a pair of wing portions one to each side of a substantially central pivot region, one wing portion of each dragging element being located to co-operate with the latch unit to effect movement thereof from its closed position to its open position, and the other wing portion of each dragging element being located for abutment by an associated drag unit.

6. A door lock as claimed in claim 5 in which the limit switch is pivotal about an axis extending parallel with the direction of sliding movement of the drag unit into its locked position engaging with the other wing portion of one of the dragging elements to prevent pivoting movement of said one dragging element on abutment by the outer drag unit.

7. A door lock as claimed in claim 1 in which each cover plate includes a corresponding plurality of hollow posts projecting inwardly therefrom, the posts of one plate co-operating with the posts of the other plate to effect intial interconnection of said plates, fastening means within the hollow posts effecting permanent interconnection of said plates.

8. A door lock as claimed in claim 1 in which the cover plates, the drag units, the core unit and the dragging elements are all moulded from a plastics material.

9. A door lock as claimed in claim 6, wherein said limit switch includes a step portion, said other wing portion of said one of the dragging elements being received within said step portion when said limit switch is in its locked position.

10. A door lock as claimed in claim 1, wherein the surface portion associated with said notch and engaged by the inner drag unit is tapered.

* * * * *